US005579532A

United States Patent [19]

Edd

[11] Patent Number: 5,579,532

[45] Date of Patent: Nov. 26, 1996

[54] ROTATING RING STRUCTURE FOR GAS TURBINE ENGINES AND METHOD FOR ITS PRODUCTION

[75] Inventor: Jon F. Edd, Monroeville, Pa.

[73] Assignee: Aluminum Company of America, Pittsburgh, Pa.

[21] Appl. No.: 899,696

[22] Filed: Jun. 16, 1992

[51] Int. Cl.[6] ..... B22F 3/16

[52] U.S. Cl. ..... 419/2; 419/4; 419/5; 419/16; 419/36; 419/51

[58] Field of Search ..... 75/204, 208 R, 75/229, 230; 228/121, 122; 416/230, 230 A; 419/2, 3, 4, 5, 12; 428/568

[56] References Cited

U.S. PATENT DOCUMENTS

| | | | |
|---|---|---|---|
| 4,060,413 | 11/1977 | Mazzei et al. | 75/208 R |
| 4,259,112 | 3/1981 | Dolowy, Jr. et al. | 75/208 R |
| 4,772,322 | 9/1988 | Bellis et al. | 75/230 |
| 4,786,566 | 11/1988 | Siemers | 428/568 |
| 4,808,076 | 2/1989 | Jarmon et al. | 416/230 |
| 4,849,163 | 7/1989 | Bellis et al. | 419/3 |
| 4,867,644 | 9/1989 | Wright et al. | 416/230 |
| 4,919,594 | 4/1990 | Wright et al. | 416/230 |
| 4,951,735 | 8/1990 | Berczik | 164/138 |
| 5,030,277 | 7/1991 | Eylon et al. | 75/229 |
| 5,173,107 | 12/1992 | Dreyer et al. | 75/229 |

*Primary Examiner*—Donald P. Walsh
*Assistant Examiner*—John N. Greaves
*Attorney, Agent, or Firm*—Glenn E. Klepac

[57] ABSTRACT

A composite jet engine compressor ring is made by casting a tape reinforced with ceramic fibers, winding the cast tape around a mandrel to form an unconsolidated ring, heating the ring to drive off binder, and pressing at a high temperature to form a unitary composite ring. Compression of the ring in an axial direction during hot pressing results in a desired axial spacing between adjacent fibers. The tape is preferably cast from a mixture of titanium base metal particles and a polyisobutylene binder dissolved in an organic solvent.

18 Claims, 3 Drawing Sheets

STEP 4

STEP 1

STEP 2

STEP 3

STEP 4

ROTATING RING STRUCTURE FOR GAS TURBINE ENGINES AND METHOD FOR ITS PRODUCTION

FIELD OF THE INVENTION

The present invention relates to high temperature metal and intermetallic matrix composite rotating ring structures for the compression systems of advanced gas turbine engines, and methods for their production. High temperature metals and intermetallics have shown promise as matrix materials because they can have high specific strength at elevated temperatures; however, they are prone to failure by creep at these conditions and must be reinforced with continuous creep-resistant fiber. Much work has been done to demonstrate the utility of creep-resistant ceramic fibers for reinforcement of these matrices.

BACKGROUND OF THE INVENTION

High temperature metal and intermetallic matrix composite rotating ring structures reinforced with ceramic fibers are known in the prior art. However, methods for making the prior art structures generally suffer from one or more serious disadvantages, making them less than entirely suitable for their intended purpose.

The high temperature metal and intermetallic matrices for such composites include titanium base metals, nickel base metals and molybdenum disilicide.

As used herein, the term "titanium base metal" refers to titanium-aluminum intermetallic compounds (hereinafter called titanium aluminides) and other intermetallics and alloys comprising at least one half titanium. The titanium aluminides are intermetallic compounds wherein titanium and aluminum are present in simple numerical ratios, and they include $Ti_3Al$, TiAl and $TiAl_3$. Some known titanium base alloys are Ti-35V-15Cr, Ti-6Al-4V, Ti-14Al-21Nb, Ti-36Al-6Nb-1Ta, Ti-10Al-26 Nb and Ti-6Al-2Sn-4Zr-2Mo (also known as Ti-6242). All of the alloy compositions herein are described with reference to weight percentages of alloying elements.

As used herein, the term "nickel base metal" refers to nickel-aluminum intermetallic compounds (also called nickel aluminides) and high temperature alloys comprising at least one half nickel. The nickel aluminides include NiAl and $Ni_3Al$.

Some references disclosing methods of manufacturing titanium base metal composites reinforced with ceramic fibers are Siemers U.S. Pat. No. 4,786,566 and Wright et al U.S. Pat. Nos. 4,867,644 and 4,919,594. Siemers discloses the radio frequency plasma spraying of molten titanium alloy particles onto an array of aligned high strength ceramic filaments. The filaments do not contact solid titanium alloy powder, as in the present invention. Siemers consolidates his fiber reinforced composite structure by hot isostatic pressing.

Wright et al U.S. Pat. Nos. 4,867,644 and 4,919,594 disclose a method of making rotor members for gas turbine engines having a titanium alloy matrix reinforced by ceramic filaments. A unidirectional mat of ceramic filaments is laminated between a pair of elongate metal foils, which are consolidated to form a composite ceramic fiber/metal matrix ribbon. The ribbon is wound spirally around a mandrel, resulting in a hoop form. The hoop form is converted into a unitary body by hot isostatic pressing.

Methods disclosed in the Siemers and Wright et al patents are difficult to control and extremely expensive to implement compared with methods starting with cast powder-ceramic fiber tapes.

Jarmon et al U.S. Pat. No. 4,808,076 claims a rotor for a gas turbine engine made from a glass or glass ceramic matrix reinforced with silicon carbide fibers. The rotor is made by sandwiching alternate layers of unidirectional silicon carbide monofilament mats between layers of glass or glass ceramic powder matrix tape reinforced with discontinuous silicon carbide yarn.

It is a principal objective of the present invention to provide a method of forming high temperature metal and intermetallic matrix composites reinforced with ceramic fibers, utilizing cast tapes having a powdered metal matrix.

An additional objective of the invention is to provide a method of making fiber reinforced composite rings wherein the product has a controlled distribution of fibers in both the radial and axial directions. The fiber distribution is preferably uniform in both directions.

Additional objectives and advantages of the invention will become apparent to persons skilled in the art from the following detailed description.

SUMMARY OF THE INVENTION

In accordance with the present invention, there is provided a film forming composition comprising a mixture of high temperature metal or intermetallic particles and an organic medium. The film forming composition comprises a mixture of about 50–75 wt. % particles and about 25–50 wt. % of the organic medium. The particles preferably comprise a titanium base metal having a top or largest particle size of greater than about 50 microns. A particularly preferred powder has a top size of about 177 microns.

The organic medium comprises a polymeric binder dissolved in an organic solvent. The binder may be a polycarbonate, polystyrene, acrylic, or polyisobutylene or a copolymer or mixture of such polymers. A polyisobutylene is particularly preferred. The organic solvent may be an aliphatic or aromatic hydrocarbon having a boiling point of less than about 100° C. but also including toluene. Toluene is particularly preferred.

Composite rings made with such binders are expected to have sufficiently low impurity contents that their strength is not substantially affected. The carbon and oxygen contents of a titanium base metal matrix made by tape casting with a polyisobutylene binder will generally be at acceptably low levels.

A fiber reinforced tape is formed by disposing a plurality of substantially continuous high strength ceramic fibers adjacent the outer surface of an elongated substrate and then casting over the fibers and substrate a coating of the mixture described above. As used herein, the term "substantially continuous" means that the ceramic fibers may contain a few discontinuities or splices. For example, one 30,000 foot length of 5.6 mil diameter ceramic fiber may have approximately five splices over its entire length. The fibers make up about 25–45 percent of the void-free volume of the tape. The tape has a width ranging from about ¼ inch (0.6 cm) to 3 inches (7.6 cm).

A doctor blade controls coating thickness. After solvent is evaporated from the coating, there is formed an elongated, ceramic fiber reinforced tape attached to the substrate. Before use, the tape is separated from the substrate. The dried tape thickness is generally the same as a desired axial spacing between adjacent ceramic fibers in the final product. The ceramic fibers in the tape are laterally spaced apart substantially farther than desired in the final product. For example, when a ring is made with cast tapes having a thickness of about 7.8 mils reinforced with 5.6 mil diameter ceramic fibers, the fibers are initially spaced apart about 12.3 mils (center-to-center) so that later axial consolidation results in a final spacing of about 7.8 mils in the axial direction. This results in a unitary ring containing 40 vol. % fibers with uniform fiber distribution in both radial and axial directions.

A hoop-wound, ceramic fiber reinforced titanium base metal composite ring is made from the tape described above. Initially, the tape is wound around a mandrel to form an unconsolidated ring. The ring is separated from the mandrel. The ring is then encapsulated in a tool, heated to drive off a major proportion of the polymeric binder, and subjected to high temperature and pressure to form a unitary ceramic fiber reinforced titanium base metal composite ring. Ceramic fibers in the tape are initially spaced apart farther than desired in the ring. However, axial compression applied during high temperature pressing reduces the void fraction and results in a desired axial spacing between adjacent ceramic fibers without damaging them. The high temperature pressing is preferably performed at a temperature of about 800°–1100° C. A temperature of about 980° C. is suitable for a titanium base metal matrix.

The ceramic fibers are preferably spaced apart in the tape by about 20% or more of their desired final spacing. In other words, axial consolidation results in about a 20% or more reduction in the spacing between adjacent fibers.

The degree of change in spacing between adjacent fibers during axial consolidation depends upon the void fraction in the powder. In a ring structure made with cast tape containing 40 vol. % ceramic fiber of 5.6 mils diameter and a regular array of fibers (regular in the x- and y-directions in cross section), the following relationships were calculated:

| Matrix Powder Density (% Theoretical) | Tape c—c Fiber Spacing (mils) | % Change in Axial Spacing During Consolidation |
|---|---|---|
| 40 | 15.0 | 47.5 |
| 50 | 12.6 | 37.5 |
| 60 | 11.0 | 28.4 |
| 70 | 9.84 | 20.0 |
| 80 | 9.06 | 13.1 |

The percentage change in axial spacing during consolidation was calculated from the formula $[(x-7.87)/x](100\%)$ wherein x is the tape c-c fiber spacing in mils and 7.87 mils is the c-c fiber spacing after consolidation.

In a preferred method of the inventions, the ceramic fiber reinforced tape is precoated with a thin layer of polymeric binder before it is wound around the mandrel. Such coating improves adhesion and arrangement of adjacent tape layers to each other.

DETAILED DESCRIPTION OF A PREFERRED EMBODIMENT

Figure 1:
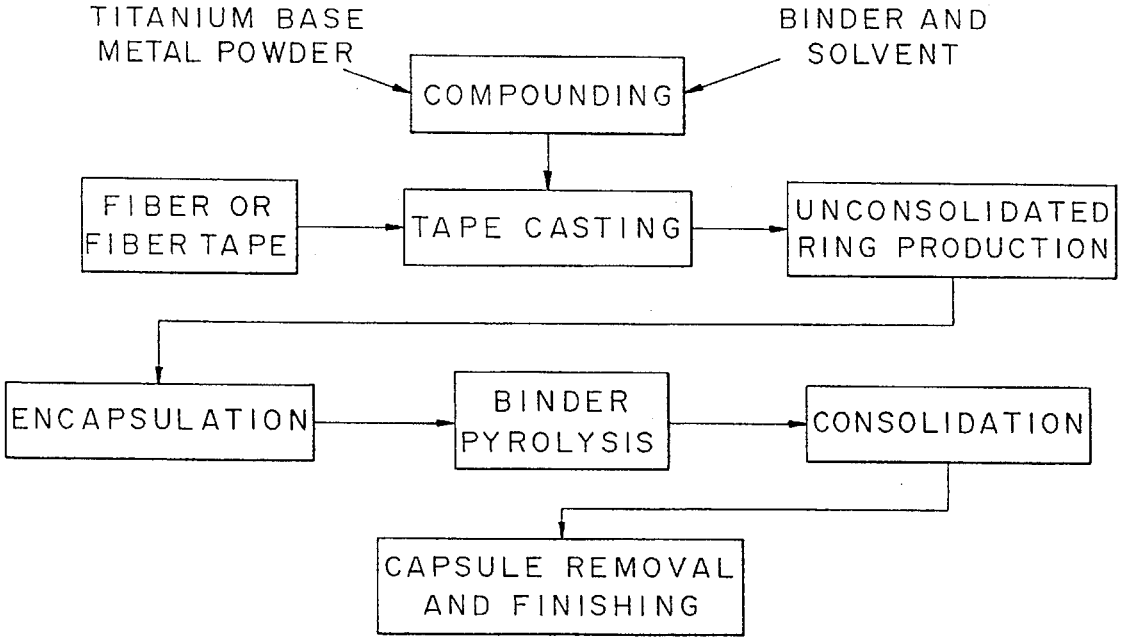
FIG. 1 is a flow sheet diagram of a method for making compressor rings in accordance with the present invention.

A particularly preferred method of the present invention is shown in the flow sheet diagram of FIG. 1. In a first step, titanium base metal powder is compounded into a slurry with an organic medium. For example, 6.42 grams of solid polyisobutylene having an average molecular weight of about 75,000 are dissolved in 80 grams of toluene to form the organic medium. Then, 156.4 grams of titanium base metal powder having a top particle size of about 177 microns are compounded with the organic medium to form a mixture having the consistency of a slurry. A particularly preferred titanium base metal is a Ti-35V-15 Cr alloy.

Figure 2:
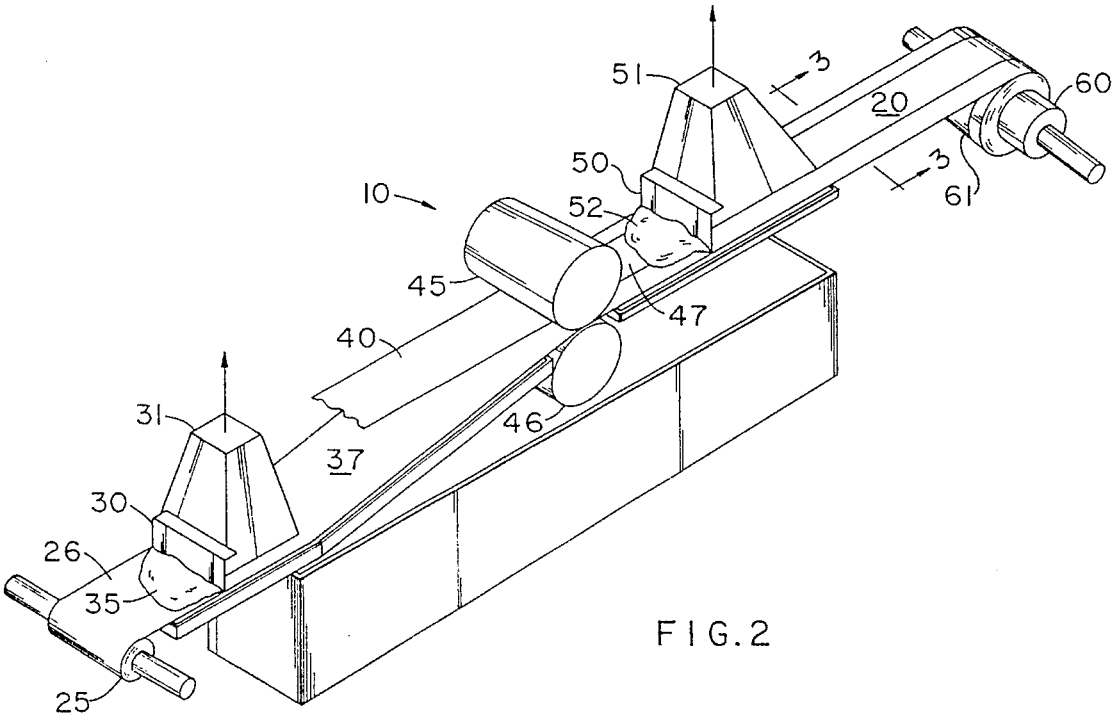
FIG. 2 is an apparatus for casting tapes reinforced with ceramic fibers.

Referring now to FIG. 2, there is shown a tape casting apparatus 10 for making elongated tapes 20. The apparatus 10 includes a reel 25 feeding an elongated substrate or PET (polyethylene terephthalate) web 26 toward a first doctor blade 30 and a first drying hood 31. A solution 35 of the polyisobutylene binder in toluene is deposited onto the substrate 26 upstream of the doctor blade 30.

The PET web 26 carries a film 37 of the binder downstream where a preformed continuous fiber tape or collimated, continuous ceramic fibers 40 are fed through a pair of rollers 45, 46 together with the binder film 37. The ceramic fibers 40 are Textron SCS-6 silicon carbide fibers. The rollers 45, 46 compress the fibers 40 into the binder film 37. A slurry 52 of polyisobutylene, toluene and titanium base metal powder is deposited on the outer surface of the PET web with attached fibers 47 upstream of a second doctor blade 50. The PET web 26 and attached fibers 47 then pass through a second doctor blade 50 and a second drying hood 51. The doctor blade 50 limits the tape 20 to a predetermined thickness. Organic solvent evaporates from the tape 20 and is removed through the hood 51. The dried tape 20 is transported by PET web 26 to a take-up reel 60 which holds a roll 61 of the tape 20 coated onto the PET web 26.

Figure 3:
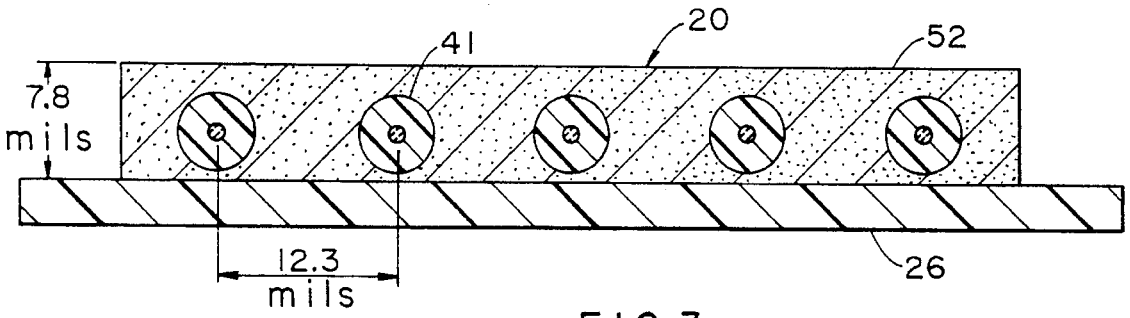
FIG. 3 is a cross-sectional view taken along the lines 3—3 of FIG. 2.
Figure 4A:
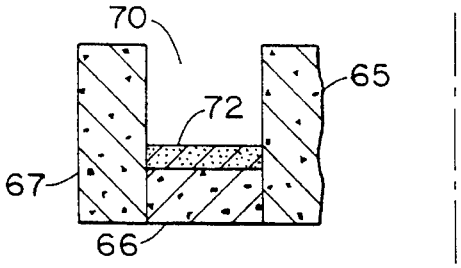
FIGS. 4A–4D are a schematic illustration of a method for making a consolidated compressor ring in accordance with the invention.
Figure 4B:
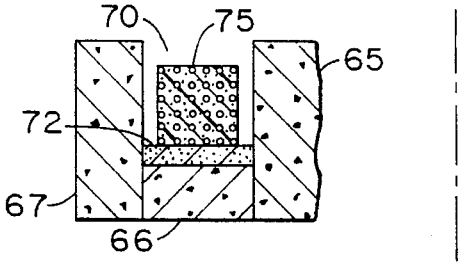
Figure 4C:
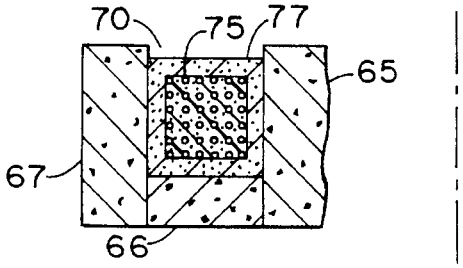
Figure 4D:
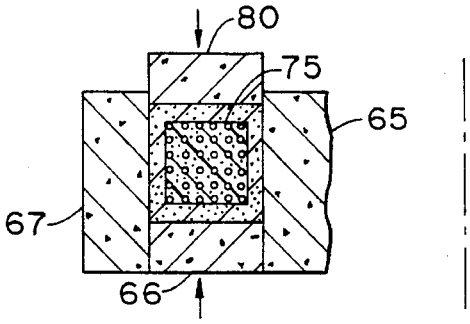

There is shown in FIG. 3 a cross-sectional view of the cast tape 20 and PET web 26. The tape 20 has a thickness of about 7.8 mils (198 microns), which is the desired center-to-center radial spacing between adjacent fibers in the final 40 vol. % fiber product. The ceramic reinforcing fibers 41 are spaced apart at a center-to-center distance of about 12.3 mils (312 microns). The cast tape 20 may have a length ranging from several centimeters to about 100 meters or more, depending upon size of the ring that is desired to be made.

Referring now to FIG. 4, there is shown a schematic diagram of an apparatus and method for making composite titanium base metal compressor rings from the cast tapes 20 described above. A generally cylindrical carbon mandrel 65 and symmetrically arranged carbon rings 66, 67 define a ring-shaped cavity 70.

Figure 5:
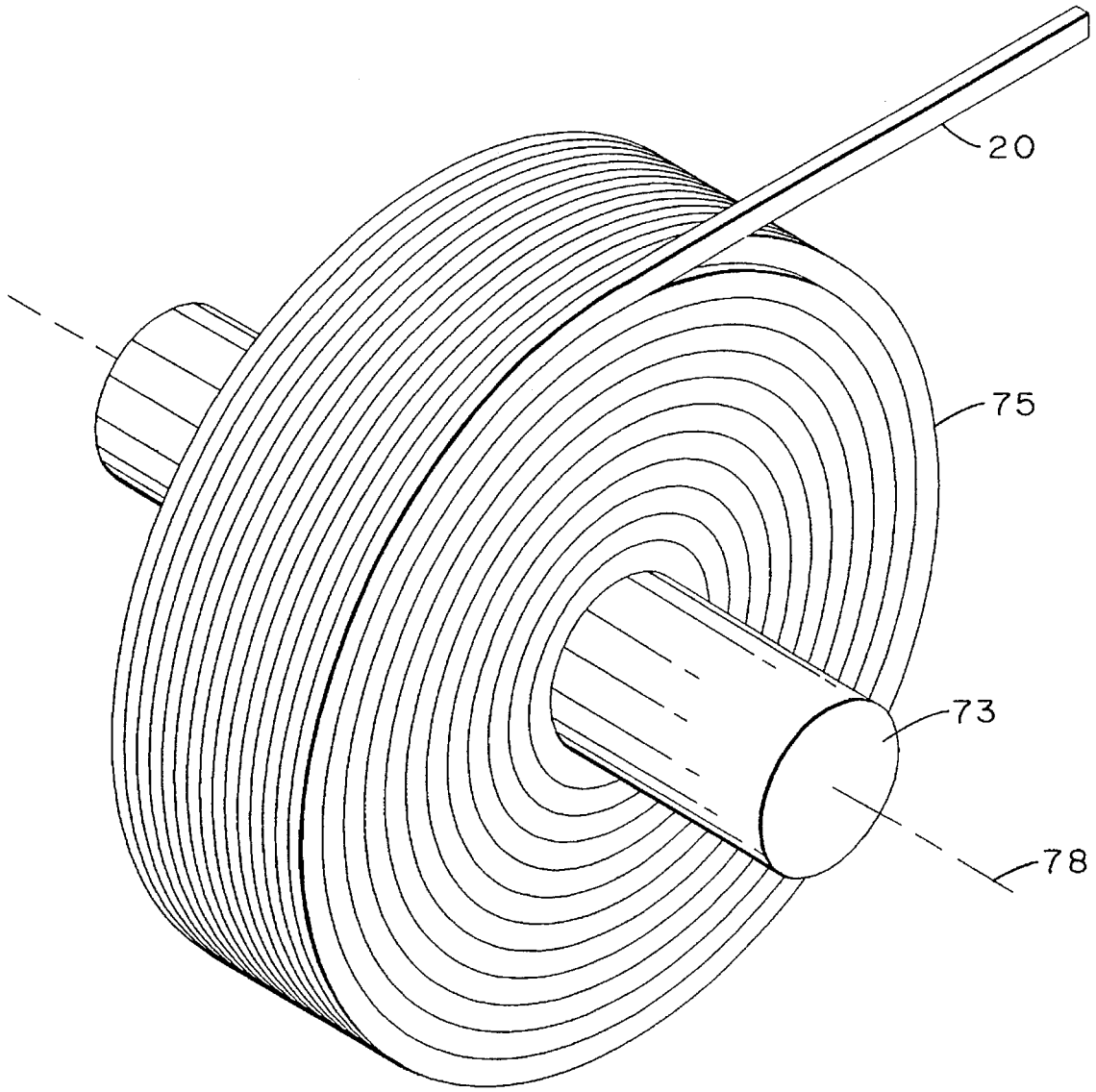
FIG. 5 is a perspective view of the tape winding method of the invention.

An inner layer 72 of titanium base metal powder is deposited in the cavity 70 alongside the first axial ring 65 in Step 1. Prior to Step 2, a sufficient length of cast tape 20 is separated from the PET web and wound circumferentially around a mandrel 73 outside the cavity, thereby forming an unconsolidated ring 75. FIG. 5 shows the formation of an unconsolidated ring 75 by winding a tape 20 around a mandrel 73 having an axis 78. The tapes are preferably coated with a polyisobutylene binder 37 (FIG. 2) in order to promote adhesion between adjacent tapes. In Step 2, the unconsolidated ring 75 is removed from its mandrel 73 and inserted in the cavity 70.

In Step 3, additional powder is packed into the cavity 70 along three sides of the preform 75. The cavity 70 is sealed off by a carbon ring 80 in Step 4 and heated to drive off most of the binder. The ring 75 is then subjected to hot pressing wherein the cavity 70 is heated to about 1800° F. (980° C.) with pressure being simultaneously applied axially inwardly (in the direction of the arrows shown in Step 4) against opposed carbon rings 66 and 80. If desired, the pressing step may be performed in a larger apparatus (not shown) which holds monolithic matrix material next to the ring 75. The monolithic material forms a compressor blade (not shown) that is reinforced by the ring 75.

Following consolidation, the rings 66, 67, 80 and mandrel 65 are cooled and removed. The compressor ring 75 is trimmed and finished as desired to form the final product.

Prior art workers avoided binder-based powder metallurgy processes like the present invention for making high temperature metal and intermetallic matrix composite structures because it was believed that a polymer binder would introduce matrix impurities into the ring structure deleterious to final product strength. I have found that impurities in the matrix resulting from certain polymeric binders can be controlled to acceptable levels. For example, cast monolithic Ti-6Al-4V sheet made with a polyisobutylene binder was found to contain 350 ppm C compared with 150 ppm C in the powder. A cast monolithic Ti-10Al-26 Nb sheet contained 99 ppm C when made with powder comprising 90 ppm C. Oxygen content increases of both sheet materials resulting from processing were also low—200 ppm in the Ti-6Al-4V alloy sheet and 100 ppm for the Ti-10Al-26 Nb material.

The foregoing detailed description of a particularly preferred embodiment of the invention has been made for illustrative purposes only. Persons skilled in the art will understand that numerous changes and adaptations can be made therein without departing from the spirit and scope of the following claims.

What is claimed is:

1. A method of making a ceramic fiber reinforced composite ring comprising:

(a) providing a film forming mixture comprised of solid particles of a high temperature metal or intermetallic matrix material and an organic medium comprising a polymeric binder dissolved in an organic solvent;

(b) placing a plurality of substantially continuous, laterally spaced ceramic fibers adjacent an elongated substrate;

(c) casting said mixture over said fibers and said substrate, thereby to form an elongated tape adjacent said substrate;

(d) separating said tape from said substrate;

(e) circumferentially winding said tape around a mandrel to form an unconsolidated ring; and (f) compressing said unconsolidated ring in an axial direction at an elevated temperature of at least about 800° C. to achieve a desired axial spacing between adjacent fibers in the ring and to form a unitary ceramic fiber reinforced composite ring.

2. The method of claim 1 wherein said solid particles comprise a titanium base metal and have a top size greater than about 50 microns.

3. The method of claim 1 wherein said solid particles comprise a titanium aluminide selected from the group consisting of TiAl, $Ti_3Al$ and $TiAl_3$ or a titanium alloy selected from the group consisting of Ti-35V-15Cr, Ti-6Al-4V, Ti-14Al-21Nb, Ti-6242, Ti-36Al-6Nb-1Ta and Ti-10Al-26Nb.

4. The method of claim 1 wherein said step (f) results in a reduction of 20% or more in the axial distance between adjacent fibers.

5. The method of claim 1 wherein said organic solvent is toluene or an aliphatic or aromatic hydrocarbon having a boiling point of less than about 100° C.

6. The method of claim 1 wherein said organic solvent is toluene.

7. The method of claim 1 wherein said polymeric binder is selected from the group consisting of polycarbonates, polystyrenes, polyisobutylenes, acrylics and mixtures and copolymers thereof.

8. The method of claim 1 wherein said polymeric binder is a polyisobutylene.

9. The method of claim 1 wherein said fibers comprise about 25–45 percent of the void-free volume of the tape.

10. The method of claim 1 wherein said fibers comprise a ceramic selected from the group consisting of silicon carbide, elemental carbon, silicon nitride, aluminum oxide, mullite and combinations thereof.

11. The method of claim 1 wherein said fibers comprise a carbon core and a layer of silicon carbide surrounding said core.

12. The method of claim 1 further comprising:

(g) evaporating said solvent from the tape after step (c) and before step (d).

13. The method of claim 1 further comprising:

(g) coating the substrate with a solution comprising a polymeric binder dissolved in an organic solvent before step (b); and (h) evaporating said solvent from the coating.

14. The method of claim 1 further comprising:

(g) heating said ring after step (e) and before step (f) to drive off a major proportion of said binder.

15. The method of claim 1 further comprising:

(g) placing said unconsolidated ring in a cavity; and (h) inserting solid particles of the high temperature metal or intermetallic matrix material in the cavity adjacent the unconsolidated ring before step (f).

16. A method of making a ceramic fiber reinforced composite ring comprising:

(a) providing an elongated tape comprised of solid particles of high temperature metal or intermetallic matrix material, a polymeric binder and a plurality of generally parallel ceramic fibers, said fibers having centers spaced apart laterally a selected predetermined lateral distance and said tape having a predetermined thickness less than said predetermined lateral distance;

(b) winding a plurality of layers of said tape into an unconsolidated ring having an axis;

(c) heating said unconsolidated ring to an elevated temperature of at least about 800° C.; and (d) maintaining said unconsolidated ring at said elevated temperature while compressing said ring in an axial direction, thereby to reduce the lateral distance between said fibers and to form a unitary, ceramic fiber reinforced consolidated ring.

17. The method of claim 16 wherein said solid particles comprise a titanium aluminide.

18. The method of claim 16 wherein said polymeric binder is a polyisobutylene.

* * * * *